US008894409B1

(12) United States Patent
La Torre et al.

(10) Patent No.: US 8,894,409 B1
(45) Date of Patent: Nov. 25, 2014

(54) COLORED FLAME CANDLE

(75) Inventors: Justin S. La Torre, White Plains, NY (US); John D. Blizzard, Bay City, MI (US)

(73) Assignee: La Torre Innovation LLC, White Plains, NY (US)

( * ) Notice: Subject to any disclaimer, the term of this patent is extended or adjusted under 35 U.S.C. 154(b) by 0 days.

(21) Appl. No.: 13/537,416

(22) Filed: Jun. 29, 2012

Related U.S. Application Data

(63) Continuation-in-part of application No. 12/972,008, filed on Dec. 17, 2010, now abandoned, which is a continuation of application No. 11/938,265, filed on Nov. 10, 2007, now Pat. No. 7,878,796, application No. 13/537,416, which is a continuation-in-part of application No. 12/930,070, filed on Dec. 24, 2010.

(60) Provisional application No. 61/284,818, filed on Dec. 24, 2009.

(51) Int. Cl.
*C11C 5/00* (2006.01)

(52) U.S. Cl.
USPC ..... 431/126; 431/125; 431/288; 431/289; 431/325; 431/4; 44/275; 44/642

(58) Field of Classification Search
CPC ..... C11C 5/00; C11C 5/004; F23D 3/16
USPC ..... 431/4, 125, 126, 288, 289; 44/275
See application file for complete search history.

(56) References Cited

U.S. PATENT DOCUMENTS

| | | | | | |
|---|---|---|---|---|---|
| 2,184,666 | A | * | 12/1939 | Fredericks | 431/126 |
| 2,188,886 | A | * | 1/1940 | Clocker | 549/253 |
| 2,196,509 | A | | 4/1940 | Cameron | |
| 2,362,502 | A | | 11/1944 | Schladt | |
| 2,398,571 | A | | 4/1946 | Young | |
| 2,481,019 | A | | 9/1949 | Joyce | |
| 2,504,211 | A | | 4/1950 | Means | |
| 2,551,574 | A | * | 5/1951 | Fredericks | 44/275 |
| 2,771,764 | A | * | 11/1956 | Moorman et al. | 431/126 |
| 3,107,511 | A | * | 10/1963 | Hamsag-Garshanin et al. | 431/126 |
| 3,150,510 | A | | 9/1964 | Klopfenstein | |
| 3,266,272 | A | * | 8/1966 | Fredericks | 431/126 |
| 3,399,284 | A | | 8/1968 | Ayers | |

(Continued)

FOREIGN PATENT DOCUMENTS

| | | |
|---|---|---|
| DE | 29906914 | 10/1999 |
| HU | 209142 | 7/1995 |
| JP | 53030176 | 3/1978 |

OTHER PUBLICATIONS

Non-Final Office Action mailed Oct. 1, 2008 in U.S. Appl. No. 11/938,265 (Paper No. 20080919).

(Continued)

*Primary Examiner* — Jorge Pereiro
(74) *Attorney, Agent, or Firm* — Bryan Cave LLP

(57) ABSTRACT

The present invention provides, inter alia, a colored flame candle. This colored flame candle contains: a wick, a body of solid combustible material surrounding the wick except a tip portion of the wick, and a first encapsulated color agent adapted to color a flame of the candle, which color agent is dispersed within the solid combustible material and/or on the wick. Also provided is a wick for a colored flame candle.

22 Claims, 1 Drawing Sheet

(56) References Cited

U.S. PATENT DOCUMENTS

| | | | | |
|---|---|---|---|---|
| 3,420,205 | A | 1/1969 | Ayers | |
| 3,582,251 | A | 6/1971 | Concannon | |
| 3,690,972 | A | 9/1972 | Kaye et al. | |
| 3,811,817 | A | 5/1974 | Mansnerus et al. | |
| 3,871,815 | A | 3/1975 | Cangardel | |
| 3,888,177 | A | 6/1975 | Tyroler | |
| 4,042,313 | A | 8/1977 | Pierce | |
| 4,309,189 | A | 1/1982 | Oberhardt | |
| 4,386,904 | A | 6/1983 | Miyahara et al. | |
| 4,732,574 | A | 3/1988 | Forschirm | |
| 4,997,457 | A | 3/1991 | Mitsusawa et al. | |
| 5,127,922 | A | 7/1992 | Bension | |
| 5,296,290 | A | 3/1994 | Brassington | |
| 5,437,410 | A | 8/1995 | Babasade | |
| 5,563,197 | A * | 10/1996 | Donatelli et al. | 524/267 |
| 6,079,975 | A | 6/2000 | Conover | |
| D456,915 | S | 5/2002 | Forkas | |
| 6,419,713 | B1 | 7/2002 | Durand et al. | |
| 6,508,644 | B1 | 1/2003 | Pesu et al. | |
| 6,521,304 | B1 * | 2/2003 | Kajiyama et al. | 428/15 |
| 6,712,865 | B2 * | 3/2004 | Lu | 44/275 |
| 6,793,484 | B2 | 9/2004 | Pesu et al. | |
| 6,921,260 | B2 | 7/2005 | Garnys | |
| 7,878,796 | B1 | 2/2011 | La Torre et al. | |
| 2002/0139041 | A1 | 10/2002 | Calzada | |
| 2002/0160327 | A1 | 10/2002 | Lim et al. | |
| 2003/0036028 | A1 | 2/2003 | Pesu et al. | |
| 2003/0064336 | A1 | 4/2003 | Welch et al. | |
| 2003/0104330 | A1 | 6/2003 | Joyner | |
| 2004/0009444 | A1 * | 1/2004 | Lu | 431/126 |
| 2004/0033463 | A1 | 2/2004 | Pesu et al. | |
| 2004/0033464 | A1 | 2/2004 | Pesu et al. | |
| 2004/0137392 | A1 | 7/2004 | Garnys | |
| 2006/0096157 | A1 | 5/2006 | Suzuki | |
| 2007/0056211 | A1 * | 3/2007 | Li et al. | 44/275 |
| 2008/0271365 | A1 * | 11/2008 | Goldfarb et al. | 44/642 |
| 2011/0150954 | A1 * | 6/2011 | Lapidot et al. | 424/401 |
| 2012/0266780 | A1 * | 10/2012 | Fink-Straube et al. | 106/435 |

OTHER PUBLICATIONS

Response to Non-Final Office Action mailed Oct. 1, 2008 in U.S. Appl. No. 11/938,265 dated Jan. 2, 2009.

Final Office Action mailed May 13, 2009 in U.S. Appl. No. 11/938,265 (Paper No. 20090503).

Response to Final Office Action mailed May 13, 2009 in U.S. Appl. No. 11/938,265 dated Aug. 13, 2009.

Non-Final Office Action mailed Dec. 23, 2009 in U.S. Appl. No. 11/938,265 (Paper No. 20091216).

Response to Non-Final Office Action mailed Dec. 23, 2009 in U.S. Appl. No. 11/938,265 dated Mar. 23, 2010.

Final Office Action mailed May 28, 2010 in U.S. Appl. No. 11/938,265 (Paper No. 20100525).

Response to Final Office Action mailed May 28, 2010 in U.S. Appl. No. 11/938,265 dated Aug. 27, 2010.

Non-Final Office Action mailed Feb. 13, 2012 in U.S. Appl. No. 12/972,008 (Paper No. 20120207).

* cited by examiner

COLORED FLAME CANDLE

CROSS-REFERENCE TO RELATED APPLICATIONS

This application is a continuation-in-part of and claims priority to U.S. patent application Ser. No. 12/972,008, filed Dec. 17, 2010, which is a continuation of and claims priority to U.S. patent application Ser. No. 11/938,265, filed Nov. 10, 2007, now issued as U.S. Pat. No. 7,878,796. The present application is also a continuation-in-part of and claims benefit to U.S. patent application Ser. No. 12/930,070, filed Dec. 24, 2010, currently pending. The '070 application claims benefit to U.S. Provisional Patent Application No. 61/284,818 filed Dec. 24, 2009, now expired. The contents of the above applications are incorporated by reference herein.

FIELD OF THE INVENTION

The present invention generally relates to illumination compositions and devices and more particularly, relates to a candle that burns with a colored flame.

BACKGROUND OF THE INVENTION

Candles are one accessory used in most households. Candles are used not only for emergency illumination purposes but, even more popularly, are used for mood enhancing or decoration. Candles which are fabricated with scented wax have also been popular in recent years to provide a pleasant scent in the environment when burned. Most existing candles that can be purchased commercially provide only an amber colored flame when ignited. Accordingly, it would be desirable to provide a variation in the color of the flame in order to further enhance the mood or to further enhance a decorative effect.

Accordingly, one object of the present invention is to provide candles that do not have the drawbacks or shortcomings of amber flamed conventional candles. It is another object of the present invention to provide a candle that can be burned with a colored flame.

SUMMARY OF THE INVENTION

One embodiment of the present invention is a colored flame candle. This colored flame candle comprises: a wick, a body of solid combustible material surrounding the wick except a tip portion of the wick, and a first encapsulated color agent adapted to color a flame of the candle, which color agent is dispersed within the solid combustible material and/or on the wick.

Another embodiment of the present invention is a colored flame candle that comprises a wick, a body of solid combustible material surrounding the wick except a tip portion of the wick, and a first color agent adapted to color a flame of the candle, which color agent is dispersed within the solid combustible material and/or on the wick, the first color agent being encapsulated in a sol gel matrix formed from a condensation of an alkoxy silane having the formula:

$$R_xSi(OR')_{4-x}$$

wherein

R is independently selected from the group consisting of $C_{1-12}$alkyl, $C_{3-8}$aryl, vinyl, allyl, and hydrogen, wherein each R is independently and optionally substituted with one or more groups selected from the group consisting of fluorine, amino, hydroxy, and combinations thereof;

R' is selected from hydrogen and $C_{1-4}$alkyl; and x is 1-3.

Yet another embodiment of the present invention is a wick for a colored flame candle. This wick comprises a wick material and an encapsulated color agent disposed in or on a surface of the wick material.

An additional embodiment of the present invention is a method for making an encapsulated color agent for a colored flame candle. This method comprises:

(a) providing an acidic solution that is at least sufficient for hydrolyzing a predetermined amount of alkoxysilane;

(b) dispersing at least a first color agent in the acidic solution;

(c) adding a predetermined amount of an alkoxysilane having the general formula:

$$R_xSi(OR')_{4-x}$$

wherein

R is independently selected from the group consisting of $C_{1-12}$alkyl, $C_{3-8}$aryl, vinyl, allyl, and hydrogen, wherein each R is independently and optionally substituted with one or more groups selected from the group consisting of fluorine, amino, hydroxy, and combinations thereof;

R' is selected from hydrogen and $C_{1-4}$alkyl; and x is 1-3, for a period of time sufficient for the alkoxysilane to hydrolyze and build a predetermined particle size.

Another embodiment of the present invention is an encapsulated color agent for a colored flame candle made according to any method disclosed herein.

BRIEF DESCRIPTION OF THE DRAWINGS

The invention will now be described, by way of example, with reference to the accompanying drawings in which.

DETAILED DESCRIPTION OF THE INVENTION

One embodiment of the present invention is a colored flame candle. This colored flame candle comprises: a wick, a body of solid combustible material surrounding the wick except a tip portion of the wick, and a first encapsulated color agent adapted to color a flame of the candle, which color agent is dispersed within the solid combustible material and/or on, e.g., a surface of, the wick.

Figure 1:
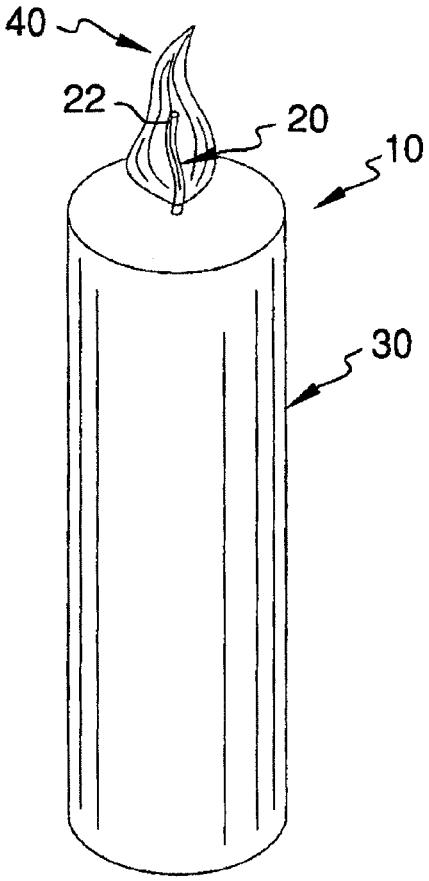
FIG. 1 is a perspective view of one embodiment of a colored flame candle according to the present invention.
Figure 2:
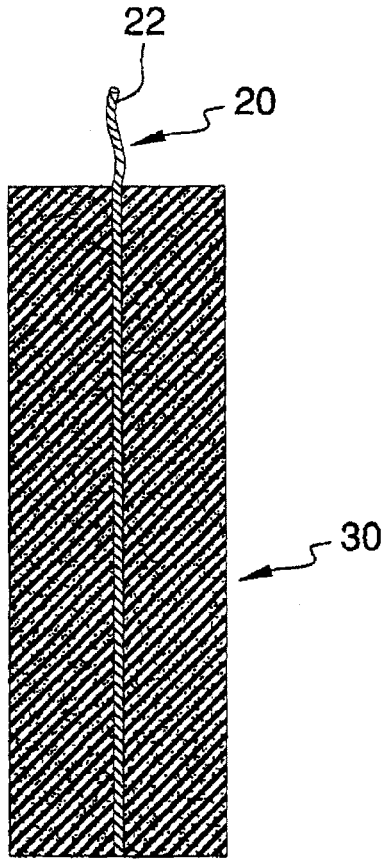
FIG. 2 is a cross-sectional view of one embodiment of a colored flame candle according to the present invention.

Referring initially to FIG. 1, wherein a perspective view of an exemplary embodiment of a colored flame candle 10 is shown. The colored flame candle 10 is constructed of a wick 20 and a body of solid combustible material 30. The body of solid combustible material 30 surrounds the wick 20 except a tip portion 22 of the wick. A first encapsulated color agent adapted to color a flame 40 of the candle is dispersed within the body of solid combustible material 30 and/or on, e.g., a surface of, the wick 20.

As used herein, the term "solid" refers to one of the three states of matter that is characterized by structural rigidity and resistance to changes of shape or volume.

As used herein, a "color agent" means a material which causes a flame to burn with a particular color. Color agents are generally metal salts. Elemental metals, such as aluminum, magnesium, titanium, copper, and sodium, may also be used as a color agent. Color agents also include color enhancers, such as calcium oxalate, hexachlorobenzene, Parlon™, polyvinychloride, Saran™, ammonium chloride, and hexchloroethane, which add depth to color or changes the color produced. For example, calcium oxalate improves color saturation to mixtures of sodium nitrate and magnesium. In another example, without chlorine donors such as hexachlorobenzene, Parlon™, polyvinychloride, Saran™, ammonium chloride, and hexchloroethane, copper oxides will emit green and red bands of light. When chlorine donors are added, however, copper oxides will produce blue flames. Preferably, the color agent, particularly when burned, is non-toxic and otherwise environmentally friendly.

As used herein, "metal" means an alkali metal, an alkali earth metal, a transition metal, or a post-transition metal. As used herein, "salts" means ionic compounds composed of cations and anions so that the product is electrically neutral. In general, metals give rise to the cations in metal salts. Metal salts of this invention include, without limitation, barium salts, copper salts, strontium salts, calcium salts, sodium salts, potassium salts, zinc salts, and lithium salts.

Examples of barium salts include, without limitation, barium chloride, barium chlorate, barium carbonate, barium nitrate, and barium oxalate. Examples of copper salts include, without limitation, copper acetoarscenate, copper carbonate, copper chloride, copper oxides, copper oxychloride, copper arsenite, and copper sulfate. Examples of strontium salts include, without limitation, strontium carbonate, strontium sulfate, strontium chloride, strontium oxalate, and strontium nitrate. Examples of calcium salts include, without limitation, calcium carbonate, calcium oxalate, calcium chloride, and calcium sulfate. Examples of sodium salts include, without limitation, sodium bicarbonate, sodium carbonate, sodium chloride, sodium oxalate, sodium nitrate, and cryolite. Examples of potassium salts include, without limitation, potassium chloride. Examples of zinc salts include, without limitation, zinc chloride. Examples of lithium salts include, without limitation, lithium carbonate and lithium chloride.

As used herein, "encapsulated" color agent means a color agent that is incorporated in a matrix. Such a matrix may be a sol gel matrix. As used herein, a "sol-gel" matrix is one that starts from a solution (sol), which acts as the precursor for a network (or gel) of either discrete particles or network polymers.

As used herein, "adapted" to color a flame of the candle means suitable for coloring the candle flame.

As used herein, "dispersed" means distributed, whether evenly or unevenly.

Various methods may be used for incorporating and distributing the encapsulated color agent in the combustible material to make the color agent suitable for coloring a candle flame. Preferably, the encapsulated color agent is mixed into a suitable form of the combustible material. Other methods may also be employed. For example, the encapsulated color agent can be added to the combustible material in the form of prilled wax granules. In this method, the granules are coated by agitating the combustible material particles and the encapsulated color agent together. The agitating step commonly consists of tumbling and/or rubbing the particles and agent(s) together. Preferably, the encapsulated color agent is distributed substantially uniformly among the particles of combustible material.

An uncoated wick material may optionally also be saturated with an aqueous solution of encapsulated color agent, for example, by dipping the wick material into an aqueous solution of the encapsulated color agent, followed by drying the saturated wick. Alternatively, the encapsulated color agent may be coated onto the wick, for example, by dipping the wick material in a powdered form of the encapsulated color agent.

In one aspect of this embodiment, the color agent is encapsulated in a sol gel matrix formed from a condensation of an alkoxy silane. Preferably, the alkoxy silane is a compound having the formula $R_xSi(OR')_{4-x}$ In this formula, R is independently selected from the group consisting of $C_{1-12}$alkyl, $C_{3-8}$aryl, vinyl, allyl, and hydrogen, wherein each R is independently and optionally substituted with one or more groups selected from the group consisting of fluorine, amino, hydroxy, and combinations thereof; R' is selected from hydrogen and $C_{1-4}$alkyl; and x is 1-3. In another preferred embodiment, the alkoxy silane is a methoxy silane. More preferably, the methoxy silane is methyltrimethoxysilane.

As used herein, a "condensation" reaction is a chemical reaction in which two molecules combine to form one single molecule, together with the loss of a small molecule.

In another aspect of this embodiment, the color agent is a metal salt. Preferably, the metal salt is selected from the group consisting of potassium chloride, copper chloride, lithium chloride, barium chloride, zinc chloride, and combinations thereof. More preferably, the metal salt is lithium chloride.

In yet another aspect of this embodiment, the weight ratio of encapsulated color agent to solid combustible material is selected from the group consisting of at least 1:100, at least 1:90, at least 1:80, at least 1:70, at least 1:60, at least 1:50, at least 1:40, at least 1:30, at least 1:20, at least 1:10, at least 1:9, at least 1:8, at least 1:7, at least 1:6, at least 1:5, at least 1:4, at least 1:3, and at least 1:2.

In an additional aspect of this embodiment, the wick is a single wick disposed in the center of the candle. The present invention further includes two or more wicks arranged in any appropriate manner that may be pleasing to a consumer. The wicks may or may not include an encapsulated color agent or other agents, including scents and the like.

In a further aspect of this embodiment, the wick comprises a second encapsulated color agent. Suitable and preferred color agents are as disclosed above. This second color agent may be the same as or different from the encapsulated color agent in the solid combustible material of the colored flame candle. It is preferred that the second color agent in the wick produce a flame of the same color as the encapsulated color agent in the combustible material. For example, both the color agent in the combustible material and in the wick may be encapsulated lithium chloride.

In another aspect of this embodiment, the body of solid combustible material has an elongated, cylindrical shape. The present invention includes all shapes and forms that conventional commercial grade candles can be fabricated in.

In an additional aspect of this embodiment, the solid combustible material comprises a material selected from the group consisting of animal waxes, plant waxes, mineral waxes, and combinations thereof. The combustible materials of the present invention are further defined and exemplified below.

In a preferred embodiment, the solid combustible material further comprises at least one scent. In the present invention, any conventional scent typically incorporated into candles may be used. In another preferred embodiment, the solid combustible material further comprises at least one dye. Again, the present invention includes incorporations of one or more conventional dyes typically used in candles. In yet another preferred embodiment, the solid combustible material further comprises two or more color agents.

Another embodiment of the present invention is a colored flame candle that comprises a wick, a body of solid combustible material surrounding the wick except a tip portion of the wick, and a first color agent adapted to color a flame of the candle, which color agent is dispersed within the solid combustible material and/or on the wick, the first color agent being encapsulated in a sol gel matrix formed from a condensation of an alkoxy silane having the formula:

$$R_xSi(OR')_{4-x}$$

wherein

R is independently selected from the group consisting of $C_{1-12}$alkyl, $C_{3-8}$aryl, vinyl, allyl, and hydrogen, wherein each R is independently and optionally substituted with one or more groups selected from the group consisting of fluorine, amino, hydroxy, and combinations thereof;

R' is selected from hydrogen and $C_{1-4}$alkyl; and x is 1-3.

Suitable and preferred color agents are as disclosed above. The weight ratio of encapsulated color agent to solid combustible material is also as disclosed above.

In one aspect of this embodiment, the alkoxy silane is a methoxy silane. Preferably, the methoxy silane is methyltrimethoxysilane.

Yet another embodiment of the present invention is a wick for a colored flame candle. This wick comprises a wick material and an encapsulated color agent disposed in or on a surface of the wick material. The wick and wick materials are as further defined below. Methods of disposing the encapsulated color agent in or on a surface of the wick material are as set forth above.

An additional embodiment of the present invention is a method for making an encapsulated color agent for a colored flame candle. This method comprises:

(a) providing an acidic solution that is at least sufficient for hydrolyzing a predetermined amount of alkoxysilane;

(b) dispersing at least a first color agent in the acidic solution;

(c) adding a predetermined amount of an alkoxysilane having the general formula:

$$R_xSi(OR')_{4-x}$$

wherein

R is independently selected from the group consisting of $C_{1-12}$alkyl, $C_{3-8}$aryl, vinyl, allyl, and hydrogen, wherein each R is independently and optionally substituted with one or more groups selected from the group consisting of fluorine, amino, hydroxy, and combinations thereof;

R' is selected from hydrogen and $C_{1-4}$alkyl; and x is 1-3, for a period of time sufficient for the alkoxysilane to hydrolyze and build a predetermined particle size.

In one aspect of this embodiment, the method further comprises grinding the product of step (c) above. Such grinding may be required to optimize uptake of the encapsulated material. Whether and to what degree grinding is desired may be determined by one skilled in the art.

Methods of grinding are well-known in the art. For example, smaller amounts of product may be placed in a container, such as a crucible, and subjected to manual grinding. Devices for grinding, such as ball mills, are widely available. Furthermore, large scale powder grinding services are available commercially, such as those offered by Fluid Energy Processing & Equipment Company, Telford, Pa.

Non-limiting exemplary solutions that are sufficient for hydrolyzing a predetermined amount of alkoxysilane and the periods of time sufficient for the alkoxysilane to hydrolyze and build a predetermined particle size are disclosed in the Examples herein and may be further apparent to those skilled in the art in view of the disclosures herein.

In a preferred embodiment, the method further comprises coating the first color agent two or more times with the alkoxysilane. Non-limiting exemplary methods of coating the first color agent are disclosed below. In another preferred embodiment, the acidic solution further comprises a second or additional encapsulated color agent(s).

Another embodiment of the present invention is an encapsulated color agent for a colored flame candle made according to any method disclosed herein.

In one aspect of this embodiment, the encapsulated color agent is ground into a fine powder. Preferably, such powder may be less than about 200 μm in diameter, such as less than about 150, 100, 50, 20, 10, 9, 8, 7, 6, 5, 4, 3, 2, 1, or 0.5 μm in diameter.

ADDITIONAL DEFINITIONS AND OTHER INFORMATION

Chemical Terms

As used herein, the term "alkyl" refers to the radical of saturated aliphatic groups, including straight-chain alkyl groups, branched-chain alkyl groups, cycloalkyl (alicyclic) groups, alkyl-substituted cycloalkyl groups, and cycloalkyl-substituted alkyl groups.

The term "$C_{x-y}$" when used in conjunction with a chemical moiety, such as, alkyl or aryl is meant to include groups that contain from x to y carbons in the chain. For example, the term "$C_{x-y}$alkyl" refers to substituted or unsubstituted saturated hydrocarbon groups, including straight-chain alkyl and branched-chain alkyl groups that contain from x to y carbons in the chain.

The term "alkoxy" refers to an alkyl group, preferably a lower alkyl group, having an oxygen attached thereto. Representative alkoxy groups include methoxy, ethoxy, propoxy, isopropoxy, tert-butoxy and the like. Other alkoxy groups within the scope of the present invention include, for example, the following:

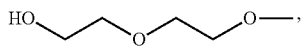

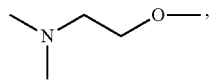

and

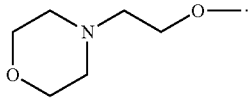

As used herein, "alkoxysilane" refers to silanes substituted with an alkoxy group. Silanes are chemical compounds of silicon and another atom such as carbon or hydrogen. Silanes have a general formula of $Si_nH_{2n+2}$ or $Si_aC_bH_c$, wherein n, a, b, and c are integers.

As used herein, the term "allyl" means a group with the structural formula —$CH_2$—CH═$CH_2$.

The terms "amine" and "amino" are art-recognized and refer to both unsubstituted and substituted amines and salts thereof, e.g., a moiety that can be represented by

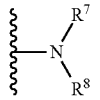

or

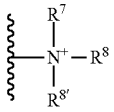

wherein $R^7$, $R^8$, and $R^{8'}$ each independently represent a hydrogen or a hydrocarbyl group, or $R^7$ and $R^8$ taken together with the N atom to which they are attached complete a heterocycle having from 4 to 8 atoms in the ring structure.

The term "aryl" as used herein includes substituted or unsubstituted single-ring aromatic groups in which each atom of the ring is carbon. Preferably the ring is a 3- to 8-membered ring, more preferably a 6-membered ring. The term "aryl" also includes polycyclic ring systems having two or more cyclic rings in which two or more carbons are common to two adjoining rings wherein at least one of the rings is aromatic, e.g., the other cyclic rings can be cycloalkyls, cycloalkenyls, cycloalkynyls, aryls, heteroaryls, and/or heterocyclyls. Aryl groups include benzene, naphthalene, phenanthrene, phenol, aniline, and the like.

The term "hydroxyl" as used herein means a group with the structure —OH.

The term "substituted" refers to moieties having substituting groups replacing a hydrogen on one or more carbons of the backbone. It will be understood that "substitution" or "substituted with" includes the implicit proviso that such substitution is in accordance with the permitted valence of the substituted atom and the substituting group, and that the substitution results in a stable compound, e.g., which does not spontaneously undergo transformation such as by rearrangement, cyclization, elimination, etc.

The term "vinyl" as used herein means a group with the structure —CH═$CH_2$.

Combustible Material

A "combustible material" means a substance that can be burned to provide heat or power. Combustible material for candles typically contains various types of waxes, but other materials, such as triglycerides and polyamides may also be used as combustible material for candles.

Waxes are chemical compounds that characteristically consist of long alkyl chains. Natural waxes are typically esters of fatty acids and long chain alcohols. Synthetic waxes are long-chain hydrocarbons lacking functional groups.

Animal waxes are those obtained from animals. The best known animal wax is beeswax. Other insects, such as *Ceroplastes ceriferus*, also secrete waxes. Other examples of animal wax include spermaceti, which occurs in large amounts in the head oil of the sperm whale; lanolin, which is a wax obtained from wool; and tallow, a by-product of beef fat rendering.

Plant waxes are those available from plant sources, including bayberry, rice bran, palm, and soy waxes.

Mineral waxes include petroleum waxes, such as paraffin, microcrystalline waxes, and petrolatums. Microcrystalline waxes are more highly refined and contain greater proportions of branched hydrocarbons than paraffin, and petrolatums are those microcrystalline waxes with a high oil content.

The petroleum wax is generally a by-product of the petroleum refining process, and may be obtained commercially from suppliers such as Witco. The quality and quantity of the wax obtained from the refining process is dependent upon the source of the crude oil and the extent of the refining. The petroleum wax component of the candle composition includes, for example, a paraffin wax, including medium paraffin wax, microcrystalline paraffin wax or a combination thereof.

Although the exact chemical compositions of these waxes are not known as the nature of these by-products vary from one distillation process to the next, these waxes are composed of various types of hydrocarbons. For example, medium paraffin wax is composed primarily of straight chain hydrocarbons having carbon chain lengths ranging from about 20 to about 40, with the remainder typically comprising isoalkanes and cycloalkanes. The melting point of medium paraffin wax is about 50° C. to about 65° C. Microcrystalline paraffin wax is composed of branched and cyclic hydrocarbons having carbon chain lengths of about 30 to about 100 and the melting point of the wax is about 75° C. to about 85° C.

Synthetic paraffin waxes may also be used. These waxes can be prepared by polymerization of carbon monoxide using the Fischer-Tropsch method and further treated for the desired hardness characteristics as disclosed, e.g., in U.S. Pat. No. 6,776,898.

Sources of petroleum waxes and some natural waxes such as beeswax, palm and soy wax are readily commercially available from vendors such as Hase Petroleum Wax Co.

Triglyceride fuels are often used as a more natural alternative to petroleum based waxes. They can be derived from both plant and animal sources, but for environmental reasons, plant-derived sources are preferable. Suitable hydrogenated vegetable oils for use in the triacylglycerol-based material includes hydrogenated soybean oil, hydrogenated cottonseed oil, hydrogenated sunflower oil, hydrogenated canola oil, hydrogenated corn oil, hydrogenated olive oil, hydrogenated peanut oil, hydrogenated safflower oil or mixtures thereof. The vegetable oil may be hydrogenated to obtain a desired set of physical characteristics, e.g., in terms of melting point and/or solid fat content.

Triglycerides may be used in blends with many other components. For example, a triglyceride-free fatty acid mixture, in some cases further blended with petroleum wax, may be used for the combustible material.

Gel candles are often desirable for their transparent quality. Compositions and methods of making such transparent gel candles are disclosed, for example, in U.S. Pat. Nos. 7,160,337; 5,843,194; and 7,544,221.

Wick

As used herein, a "wick" is a material through or along which a pool of liquefied candle fuel, e.g., a combustible material according to the present invention, can flow to be vaporized and burned in the candle flame. A wick normally extends longitudinally through a candle body. More than a single wick may be utilized in a spaced relationship, but usually a single wick component is centrally disposed in a shaped candle body. When a candle wick is ignited, the wick is adapted to combust gradually, so that both the wick and candle body are consumed. Characteristics of the wick are varied to achieve desirable characteristics such as wick/combustible material consumption rate, flame/wax pool size, stiffness to prevent the wick from extinguishing in the liquid pool of combustible material, tethering to prevent the wick from floating in the liquid pool of combustible material, curling to allow the flame to consume the wick without trimming as the combustible material is exhausted, among other characteristics.

Common wick materials include many cellulosic materials such as braided, woven or knit cotton thread or yarn, or even wood. The thickness of the wick will depend on the wick material, the combustible material, the candle size and the desired application. A larger wick will generally produce a larger flame, a larger pool of liquefied combustible material and a faster rate of combustible material consumption. Thus, a thicker candle will typically require a thicker wick. Similarly, for a free-standing candle a smaller wick may be desired to maintain the pool of liquefied combustible material within the outer rim of the candle and avoid drips whereas for a container candle, a larger wick may be preferred so the pool of liquefied combustible material reaches the container wall for more complete combustible material consumption. Larger candles may employ a plurality of wicks rather than increasing the size of a single wick.

A composite wick structure composed of a cellulose acetate core and a fibrous coating in order to achieve the rigidity and curling characteristics is disclosed, e.g., in U.S. Pat. No. 2,829,511. This type of wick comprising a structural core and an outer fibrous wick can be formed by winding or weaving the fibers around the core as described.

A wick may be coated or saturated with a material such as paraffin wax to prevent unwinding of the fibers and provide an initial fuel source upon lighting the candle.

An alternative to a central core providing stiffness to a wick is to treat a fibrous wick with a combustible stiffening agent whose melting temperature is slightly above that of the combustible material used in the particular candle; this is disclosed, e.g., in U.S. Pat. No. 3,940,233.

An additional wick composition comprising extruded or molded polymer fibers containing a cellulosic filler is disclosed, e.g., in U.S. Pat. No. 6,013,231.

An exemplary base which serves to tether a wick in a pool of liquefied combustible material as well as prevent flashing is disclosed, e.g., in U.S. Pat. No. 6,062,847.

Various candle wick and wick making supplies are readily available from commercial sources such as The Candlewic Company, Doylestown, Pa.

Dyes, Scents, and Other Additives

A wide variety of dyes and scenting agents, well known in the art of candle making, are available for use with combustible materials. As used herein, a "dye" is any coloring agent that imparts a color to the combustible material when the candle is not lit. Typically, one or more dyes is employed to provide the desired hue to the color agent, and one or more perfumes, fragrances, essences or other aromatic oils is used provide the desired odor. The dyes and scents generally also include liquid carriers which vary depending upon the type of color- or scent-imparting ingredient employed. The use of liquid organic carriers with dyes and scents is preferred because such carriers are compatible with petroleum-based waxes and related organic materials. As a result, such dyes and scents tend to be readily absorbed into combustible materials. It is especially advantageous if dyes and scents are introduced into the waxy material when it is in the form of prilled granules.

The dye is an optional ingredient. Dyes are typically added in a quantity of about 0.001-2 weight percent of the solid combustible material, e.g., a waxy base composition. If a water-insoluble dye, e.g., a pigment, is employed, it is typically an organic toner in the form of a fine powder suspended in a liquid medium, such as a mineral oil. It may be advantageous to use a pigment that is in the form of fine particles suspended in a vegetable oil, e.g., a natural oil derived from an oilseed source such as soybean or corn oil. The pigment is typically a finely ground, organic toner so that the wick of a candle formed eventually from pigment-covered wax particles does not clog as the wax is burned. Pigments, even in finely ground toner forms, are generally in colloidal suspension in a carrier.

If a water-soluble dye constituent is utilized, it may be dissolved in an organic solvent. A variety of water-soluble dyes suitable for candle making are disclosed, e.g., in U.S. Pat. No. 4,614,625, the disclosure of which is herein incorporated by reference. The preferred carriers for use with organic dyes are organic solvents, such as relatively low molecular weight, aromatic hydrocarbon solvents; e.g. toluene and xylene.

Candles often are designed to appeal to the olfactory as well as the visual sense. This type of candle usually incorporates a fragrance oil in the solid combustible material, e.g., waxy body material. As the waxy material is melted in a lighted candle, there is a release of the fragrance oil from the liquefied wax pool. The scent may be an air freshener, an insect repellent or serve more than one of such functions.

The air freshener ingredient commonly is a liquid fragrance comprising one or more volatile organic compounds which are available from perfumery suppliers such International Flavors and Fragrances Inc., Firmenich Inc., Takasago International Inc., Belmay, Noville Inc., Quest International Fragrances Co., and Givaudan-Roure Corp. Most conventional fragrance materials are volatile essential oils. The fragrance can be a synthetically formed material, or a naturally derived oil such as oil of Bergamot, Bitter Orange, Lemon, Mandarin, Caraway, Cedar Leaf, Clove Leaf, Cedar Wood, Geranium, Lavender, Orange, Origanum, Petitgrain, White Cedar, Patchouli, Lavandin, Neroli, Rose and the like.

A wide variety of chemicals are known for perfumery such as aldehydes, ketones, esters, alcohols, terpenes, and the like. A fragrance can be relatively simple in composition, or can be a complex mixture of natural and synthetic chemical components. A typical scented oil can comprise woody/earthy bases containing exotic constituents such as sandalwood oil, civet, patchouli oil, and the like. A scented oil can have a light floral fragrance, such as rose extract or violet extract. Scented oils also can be formulated to provide desirable fruity odors, such as lime, lemon or orange.

Synthetic types of fragrance compositions either alone or in combination with natural oils, such as those disclosed, e.g., in U.S. Pat. Nos. 4,314,915; 4,411,829; and 4,434,306, may be used in the present invention and are incorporated herein by reference. Other artificial liquid fragrances include geraniol, geranyl acetate, eugenol, isoeugenol, linalool, linalyl acetate, phenethyl alcohol, methyl ethyl ketone, methylionone, isobornyl acetate, and the like. The scent can also be a liquid formulation containing an insect repellent such as citronellal, or a therapeutic agent such as eucalyptus or menthol. Once the dyes and scents have been formulated, the desired quantities are combined with the combustible material which will be used to form the body of the candle. For example, the dyes and/or scents can be added to the combustible material in the form of prilled wax granules. When both dyes and scents are employed, it is generally preferable to combine the two together and then add the resulting mixture to the combustible material. It is also possible, however, to add the agents separately to the combustible material. Having added the agent or agents to the combustible material, the granules are coated by agitating the combustible material particles and the dye and/or scents together. The agitating step commonly consists of tumbling and/or rubbing the particles and agent(s) together. Preferably, the agent or agents are distributed substantially uniformly among the particles of combustible material, although it is entirely possible, if desired, to have a more random pattern of distribution. The coating step may be accomplished by hand, or with the aid of mechanical tumblers and agitators when relatively large quantities of prilled combustible material are being colored and/or scented.

Certain additives may be included in the combustible material to decrease the tendency of colorants, fragrance components and/or other components of the combustible material to migrate to an outer surface of a candle. Such additives are referred to herein as "migration inhibitors." The combustible material may include 0.1 to 5.0 weight percent of a migration inhibitor. One type of compound which can act as a migration inhibitor is polymerized alpha olefins, more particularly polymerization products formed from alpha olefins having at least 10 carbon atoms and, more commonly from one or more alpha olefins having 10 to about 25 carbon atoms. One suitable example of such a polymer is an alpha olefin polymer sold under the tradename Vybar™ 103 polymer (melting point 168° F., available from Baker-Petrolite, Sugarland, Tex.). The inclusion of sorbitan triesters, such as sorbitan tristearate and/or sorbitan tripalmitate and related sorbitan triesters formed from mixtures of fully hydrogenated fatty acids, in the present wax compositions may also decrease the propensity of dyes, fragrance components and/or other components of the wax to migrate to the candle surface. The inclusion of either of these types of migration inhibitors can also enhance the flexibility of the base wax material and decrease its chances of cracking during the cooling processes that occur in candle formation and after extinguishing the flame of a burning candle. For example, it may be advantageous to add up to about 5.0 weight percent and, more commonly, about 0.1-2.0 weight percent of a migration inhibitor, such as an alpha olefin polymer, to the present wax materials.

Other additives may also be incorporated into the combustible material. These additives include a UV absorber, preferably a benzotriazole, in combination with a hindered amine which is substituted on the N-atom by an alkoxy, a cycloalkoxy or an hydroxy-substituted alkoxy moiety, as disclosed, e.g., in U.S. Pat. No. 6,221,115, to control or modify the properties of the candle to insure proper burning, reduce channeling, aid in uniform melting, and the like. Preservatives also can be incorporated as provided for in, e.g., U.S. Pat. No. 7,220,288. Tertiary butylhydroquinone in concentration of 0.25%-0.5% may be added to reduce the severity of polymerization, skinning, tunneling and flame attenuation. Insect repellants such as citronella, as set forth previously, also are common candle additives. Further examples of appropriate repellant additives, methods of incorporation and methods of masking their odors can be found in, e.g., U.S. Pat. No. 4,449,987.

Methods of Making Candles

A candle is typically made by pouring a molten combustible material, such as molten wax, into a mold and cooling the combustible material, thereby forming a body for the candle. A wick is inserted into solid combustible material. There are many ways of inserting the wick into the combustible material.

In one way of making a pillar candle, which is a cylindrical candle usually having a height greater than its width, the wick is placed upright in a cylindrical mold, and the combustible material is poured into the mold. The combustible material is poured to a level at which a majority of the wick is submerged in the molten combustible material, and a top portion of the wick remains above a top surface of the molten combustible material. When the molten combustible material solidifies, the body of solid combustible material is formed with the wick imbedded therein. The top portion of the wick extends from the top surface of the body of combustible material for initially lighting the candle.

Other processes that are utilized for making candles include the compression of prilled combustible material, such as wax pellets, and the extrusion of the combustible material. The processes produce a body of solid combustible material in which a hole can be formed for inserting a wick, and the processes permit an artisan to employ techniques for making the body have a particular size and shape.

Another method of candle making forms a body of solid combustible material in indistinguishable concentric layers around a wick. For example, serially dipping the wick in the liquefied combustible material, which may be for example, molten wax, and allowing the wax to cool into a layer around the wick forms a dipped candle. Repeating this technique builds concentric layers around the wick. The dipped candle typically has a tapered top end, from which a top portion of the wick extends for lighting the candle, and a substantially planar bottom surface. Most commonly, all the layers are of the same color. When viewing the bottom surface, the concentric layers are usually indistinguishable, because the layers are of the same color and the outermost layer typically coats the bottom surface. However, for making the layers distinguishable there exists a technique in which the dipped candle is formed using a colored wax for each concentric layer. Some or all of the layers have different colors. Selected areas of the candle are carved away or cut into, usually in decorative patterns, to expose the multiple colors of the different layers.

Similarly, a molded pillar candle or a dipped candle having built up layers of a single color can be coated with a final layer of a different colored wax.

A less well-known method for making a candle is to roll a sheet of solid combustible material from a slab, which has a length and width considerably greater than its thickness. A wick is placed near an edge of the slab, lying parallel to that edge, with an overhanging portion of the wick extending past an adjacent edge. Then, beginning with the edge near the wick, the slab is rolled around the wick, thereby forming a rolled body of combustible material. A majority of the wick becomes imbedded centrally in the rolled body of solid combustible material, with the overhanging portion of the wick extending beyond a top surface of the rolled body of solid combustible material. Viewing the top surface, the rolled body appears layered, because it is in a spiral pattern around the centrally imbedded wick. However, the spiral pattern and layered appearance may not be clearly seen, for example, if the top surface is smoothed over to eliminate the visible interface within the spiraling layer, which may be done for aesthetic purposes.

For the methods described above that utilize a mold, and for other candle-making methods that utilize a mold for forming a body of solid combustible material, the mold has a predetermined shape for ultimately incorporating into a candle. Such shapes typically serve an aesthetic purpose, although shapes may be imposed to serve a functional role. For the pillar candle, the shape of the candle elicits the method of manufacturing the candle; the shape of the mold is retained through the method and is reflected in the shape of the candle.

However, for the rolled candle and the dipped candle, the respective methods of manufacture may not be readily deduced by observing the shapes of those candles.

In addition to standard candle-making methods, where the candle is formed around the wick, a wick can be replaced or inserted into a candle made without a wick. For example, U.S. Pat. No. 7,553,154 discloses a process for adding a candle wick to a candle including the steps of: selecting a wick cavity forming tool having an electrically heatable, elongated tip and having a marked position to indicate the depth of the bore for a candle wick; electrically heating the elongated tip; removing an existing wick from a candle; inserting the heated elongated tip into a wax candle to form a bore thereinto having softened wax therearound; inserting a wick into the wax candle bore having softened wax therearound created by the heated wick cavity forming tool; cutting the added wick; and removing excess wax from the candle with the electrically heated elongated tip; whereby a wick is formed into a candle.

The following examples are provided to further illustrate the compositions, devices, and processes of the present invention. These examples are illustrative only and are not intended to limit the scope of the invention in any way.

EXAMPLES

Example 1

There are a variety of encapsulation processes available using silicone technologies. However, these are not usually used to encapsulate metal oxides other than silicon dioxide. When burned, the silicon dioxide produces a colorless (white) flame and should not interfere with the color enhancement of the metal oxide color.

The solubility in water (Ksp) and the color produced upon combustion of the following metal salts were examined.

TABLE 1

| Metal Salt | Flame Color | Ksp |
|---|---|---|
| Potassium Chloride (KCl) | Violet | total solubility |
| Copper Chloride ($CuCl_2$) | Emerald Green | 70.6 gm/100 ml |
| Lithium Chloride (LiCl) | Crimson | 76.9 gm/100 ml |
| Barium Chloride ($BaCl_2$) | Yellow-green | 31 gm/100 ml |
| Zinc Chloride ($ZnCl_2$) | | 81 gm/100 ml |

Example 2

The chemistry to encapsulate the metal ion is based on hydrolysis and condensation of alkoxy silanes. This can be represented by the following chemical equation:

$$R_xSi(OR')_{4-x}+H_2O+H^+ \rightarrow R_xSi(OH)_y+R'OH \rightarrow R_xSiO_y+R'OH,$$

wherein x and y are integers, preferably 1-3.
wherein R and R' are as previously defined. This forms a sol gel structure into which the metal salt is incorporated or encapsulated within the sol gel matrix during the condensation reaction of the sol gel.

It is necessary to carefully control the condensation reaction of the sol gel to achieve the desired results.

It is also required to determine the solubility constant (Ksp) of each of the metallic salts, as a stoichiometric amount of water is required to properly form the sol gel and the water is also necessary to dissociate the metallic salt in the mixture.

As an example of the metallic salt/sol gel processing, potassium chloride or other metal salts shown in Table 2 below were dissolved in acidified water in the amount shown (in grams). After dissolution, methyltrimethoxysilane (MTM) was slowly added to allow for the hydrolysis of the alkoxy silane. The methyltrimethoxysilane was added in two equal portions to allow the sol gel to build to the appropriate particle size. This is the critical step in the process as a particle size too small will not encapsulate the metal salt and a particle size too large will cause premature precipitation. The sol gel solution is then neutralized to cause the precipitation of the matrix. The sample is dried in an oven at 45° C. overnight to remove the water followed by grinding the resulting metallic salt sol gel to a powder about the size of table salt.

The resulting powder was placed into a propane generated flame to observe the resulting flame color and compared to the flame color of metal salt without the sol gel process. See Table 2 below. This process resulted in approximately less than one gram of each sample.

TABLE 2

| | Experiment No. | | | | | |
|---|---|---|---|---|---|---|
| | 2 | 4 | 6 | 8 | 10 | Solubility |
| WATER | 35 | 35 | 35 | 35 | 35 | |
| K | 8 | | | | | Infinite |
| Cu | | 8 | | | | 70.6/100 ml |
| Li | | | 8 | | | 76.9/100 ml |
| Ba | | | | 8 | | 31/100 ml |
| Zn | | | | | 8 | 81/100 ml |
| MTM[1] | 2.3 | 2.3 | 2.3 | 2.3 | 2.3 | |
| MTM[2] | 2.3 | 2.3 | 2.3 | 2.3 | 2.3 | |
| NaOH | 1.2 | 1.2 | 0 | 1.2 | 0 | |
| Dry film | | | | | | |
| Flame Color of metal salt | yellow | bright blue green | red | Yellow, blue, green | | |
| Product | 3 g | 3 g | | 3 g | | |
| Water | 15 g | 15 g | | 15 g | | |
| Dry weight | 0.46 g | 0.61 g | | 0.26 g | | |
| Flame Color of micro-encapsulate | Yellow orange | bright blue green | Bright red | Color-less | | |

[1]first addition of methyltrimethoxysilane
[2]second addition of methyltrimethoxysilane

Example 3

In order to evaluate this processing further, larger quantities of metallic salt sol gel materials were made. See Table 3 below. During this experimental procedure, it was noted that either an exothermic or an endothermic reaction resulted during the dissolution of the metal salt depending on the anion of the salt.

TABLE 3

| | Experiment No. | | | | | |
|---|---|---|---|---|---|---|
| | 20 | 21 | 22 | 23 | 24 | Solubility |
| | 175 | 175 | 175 | 175 | 175 | |
| K | 40 | | | | | Infinite |
| Cu | | 40 | | | | 70.6/100 ml |
| Li | | | 40 | | | 76.9/100 ml |
| Ba | | | | 40 | | 31/100 ml |
| Zn | | | | | 40 | 81/100 ml |
| RXN | Endo | Exo | Exo | Endo | Exo | |
| MTM[1] | 11.5 | 11.5 | 11.5 | 11.5 | 11.5 | |
| MTM[2] | 11.5 | 11.5 | 11.5 | 11.5 | 11.5 | |
| NaOH | 6 | 6 | 6 | 6 | 6 | |
| Solution Color | opaque | blue/ green | opaque | opaque | opaque | |

TABLE 3-continued

| | Experiment No. | | | | | |
|---|---|---|---|---|---|---|
| | 20 | 21 | 22 | 23 | 24 | Solubility |
| Exotherm Temperature | | 40° C. | 60° C. | 17° C. | | |

[1]first addition of methyltrimethoxysilane
[2]second addition of methyltrimethoxysilane

Example 4

Because the sol gel process requires a significant amount of water for the sol gel, the water that is not utilized in the actual condensation reaction of the alkoxy silane must be removed at the end of the encapsulation process. To optimize the processing and to eliminate as much water in the initial processing as practically possible, experiments were performed based on the Ksp of the metal salt. Only enough water, plus a 10% excess for the condensation of the alkoxysilane, was used in the experiments. See Table 4, which summarizes experiment numbers 12-14. This would result in a significant increase in the yield of the final product. The exotherm or endotherm of the metal salt was measured. It was found that lithium chloride had a 37° C. exotherm, cupric chloride had a 13° C. exotherm, and barium chloride had a 5° C. endotherm. These numbers agree quite well based on the reactivity of the metal used in the salt.

A representative detailed experimental procedure is as follows: To a 200 ml beaker, 35 grams of distilled water was added. To this solution, 8 grams of lithium chloride was added with agitation. The temperature of the distilled water was measured at 23° C. During dissociation of the lithium chloride the temperature rose to 60° C., an exotherm of 37° C. The resulting lithium chloride solution was mixed at ambient temperature for about two hours. After cooling back to 23° C., 2.3 grams of Dow Corning 6070 Silane (methyltrimethoxysilane) was added drop wise over a period of about 2 minutes and was mixed using a magnetic stir bar at mild to moderate agitation rate. After continuous mixing for 60 minutes, 2.3 grams of Dow Corning 6070 Silane (methyltrimethoxysilane) was again added drop wise over a period of about 2 minutes and was mixed using a magnetic stir bar at mild to moderate agitation rate for 120 minutes. The resulting reaction product was filtered through filter paper to collect the microencapsulated metal salt. This was dried for 16 hours at 45° C. resulting in a white crystalline powder. This was placed in a porcelain crucible and ground to a fine white powder about the size of table salt. A small sample (approximately 0.5 to 1.0 gram) was placed on the end of a spatula and placed in the reducing portion of a propane flame. This material produced a bright red flame.

TABLE 4

| Experiment No. | 12 | 13 | 14 |
|---|---|---|---|
| WATER | 35 | 35 | 35 |
| K | | | |
| Cu | | 28 | |
| Li | 30.4 | | |
| Ba | | | 11.7 |
| Zn | | | |
| MTM[1] | 8.7 | 8.7 | 8.7 |
| MTM[2] | 8.7 | 8.7 | 8.7 |

TABLE 4-continued

| Experiment No. | 12 | 13 | 14 |
|---|---|---|---|
| Exo temp | 60° C. | 40° C. | 17° C. |
| solution pH | | 2 | 6 |

[1]first addition of methyltrimethoxysilane
[2]second addition of methyltrimethoxysilane

Example 5

An additional experiment was performed to determine whether the sol gel product could be added to existing sol gel products, much like producing an "onion". To examine this, the microencapsulated metal oxide sol gel from experiment 12 (lithium chloride) was used. Table 5 summarizes Experiment number 15. In that experiment, water and lithium chloride were allowed to equilibrate, and a sample of the final product from experiment 12 (see Table 4 above) was added to this mixture. The product from experiment 12 was not soluble in water. However, upon the addition of the first quantity of methyltrimethoxysilane, the material was able to go into solution. The second addition of methyltrimethoxysilane completed the final microencapsulated product.

TABLE 5

| Experiment No. | 15 |
|---|---|
| WATER | 17.5 |
| Li | 15.7 |
| RXN | |
| MTM | 4.35 |
| MTM | 4.35 |
| sample 12 | 5.0 |
| Exo temp | 67° C. |
| solution pH | 4 |

Example 6

A larger quantity of the microencapsulated lithium salt was made to incorporate it into a wax. The procedure from Example 4 above was scaled up and was used to make a sufficient quantity of material for incorporation. Table 6 summarizes the starting materials and the amounts used in Experiment No. 16.

TABLE 6

| Experiment No. | 16 |
|---|---|
| WATER | 70 |
| Li | 62.8 |
| RXN | |
| MTM | 17.4 |
| MTM | 17.4 |
| Exo temp | 77° C. |
| solution pH | 4 |

This product produced the highest exotherm of any of the experimental materials to date, the final exotherm temperature being 77° C.

The wax that the microencapsulated metal salt was incorporated into is a "Premium Candle Wax" standard manufactured by Yaley Enterprises in Redding, Calif. This wax has a melting point of 148° F. and is designed for candles made in molds.

The wick was also purchased from Yaley Enterprises of Redding, Calif. It is a medium lead free wire candle wick. It has a lead free zinc core center.

200 grams of the wax was melted in a beaker at 150° F. for approximately 30 minutes to completely melt the wax. Ten gram samples were taken off from the wax and poured into aluminum pans. To separate samples, 0.1, 0.5, 1.0, 2.5, and 5.0 grams of the microencapsulated lithium salt was added and mixed into the molten wax. As the wax was cooling and solidifying, the wick was placed into the candle and the candle was allowed to continue to cool and harden.

After hardening, the candle was lit and the resulting flame color and strength of the flame color was observed. While all of the candles exhibited a red flame upon burning, differences in the strength and duration of the color was noted. See Table 7 below. While a 1% addition level did produce a red flame, it was sporadic and not very strong. At a 5% addition level, the flame color was better and not quite as sporadic, but still was not a strong, steady red colored flame. Finally, at a 10% addition level the flame appeared red, and was fairly consistent.

TABLE 7

| | | | | | |
|---|---|---|---|---|---|
| Wax | 10.0 | 10.0 | 10.0 | 10.0 | 10.0 |
| Encapsulated lithium salt from Experiment 16 | 0.1 | 0.5 | 1.0 | 2.5 | 5.0 |
| Flame color | red | red | Red | red | Red |
| Flame strength | Poor | Fair-good | Excellent | Excellent | Excellent |

Example 7

An additional candle was made. This candle consisted of using the procedure and testing disclosed in Example 6 above. However, a modified procedure was used to incorporate the microencapsulated lithium salt as set forth below.

In this procedure, 1.0 gm of the microencapsulated lithium salt and 1.0 gm of the lithium salt was added to 10 grams of the melted wax as used in Example 6. When this candle was burned a red, consistent flame was observed.

Example 8

To a 4000 ml beaker, 2000 grams of distilled water was added. The water that is not utilized in the actual condensation reaction of the alkoxy silane was removed at the end of the encapsulation process. To optimize the processing and to eliminate as much water in the initial processing as practically possible, earlier experiments were performed based on the Ksp of the metal salt. Only enough water, plus a 10% excess for the condensation of the alkoxysilane, was used in the experiments. This resulted in a significant increase in the yield of the final product. To this solution, 1420 gm of lithium chloride was added with agitation. The temperature of the distilled water was initially measured at 22° C. During dissociation of the lithium chloride, the temperature rose to 88° C., an exotherm of 66° C. After cooling back to 23° C., 348 gm of Dow Corning 6070 Silane (methyltrimethoxysilane) was added drop wise and allowed to mix (hydrolyze). After continuous mixing for 60 minutes, an additional 348 grams of Dow Corning 6070 Silane (methyltrimethoxysilane) was added drop wise and allowed to mix (hydrolyze) for 120 minutes. The methyltrimethoxysilane was added in two equal portions to allow the sol gel to build to the appropriate particle size. The resulting reaction product was filtered through filter paper to collect the microencapsulated metal salt. This was dried for 16 hours at 45° C. resulting in a white crystalline powder. This produced a larger quantity of the microencapsulated product. There were large "clumps" of product which required grinding to achieve a fine powder to incorporate into the wax.

A small amount (approximately 25 grams) of this product was placed in a porcelain crucible and ground to a fine white powder.

Encapsulated copper and barium metal salts were made in a 2000 gram batch. The exotherm or endotherm of the metal salt dissolution for the other metal salts was also measured. Cupric chloride had a 4° C. exotherm and the barium chloride had a 5° C. endotherm. These data agree quite well based on the reactivity of the metal used in the salt and previous experiments. As with the lithium microencapsulation, there were large "clumps" of product which required grinding to achieve a fine powder to incorporate into the wax. A small amount (approximately 25 grams) of this product was placed in a porcelain crucible and ground to a fine white powder. Table 8 shows the actual amount of ingredients used with the exotherm (endotherm) temperatures and pH recorded in the larger batch.

TABLE 8

| | | | | |
|---|---|---|---|---|
| WATER | grams | 2000 | 2000 | 2000 |
| K | grams | | | |
| Cu | grams | | | 1400 |
| Li | grams | | 1420 | |
| Ba | grams | 620 | | |
| MTM | grams | 348 | 348 | 348 |
| MTM | grams | 348 | 348 | 348 |
| Exo temp initial | ° C. | 22 | 22 | 22 |
| Exo temp final | ° C. | 17 | 88 | 26 |
| solution pH | | 6 | 4 | 2 |

Example 9

The metal salts encapsulated within the sol gel matrix obtained according to Example 8 set forth above are milled to a particle size of less than 0.5 microns using a ball mill, or similar device. These fine ground powders are dissolved in wax at a metal salt:wax weight ratio of 1:100, 1:20, 1:10, 1:4, and 1:2, and are made into a candle. The resulting candles are expected to burn with colored flames of various quality in strength and duration.

While the preferred embodiments of the invention have been described above, it will be recognized and understood that various modifications can be made in the invention and the appended claims are intended to cover all such modifications which may fall within the spirit and scope of the invention.

What is claimed is:

1. A wick for a colored flame candle comprising a wick material and an encapsulated color agent disposed in or on a surface of the wick material, wherein the color agent is encapsulated in a sol gel matrix formed from a condensation of an alkoxy silane.

2. A colored flame candle comprising: a wick, a body of solid combustible material surrounding the wick except a tip portion of the wick, and a first encapsulated color agent adapted to color a flame of the candle, which color agent is dispersed within the solid combustible material and/or on the wick wherein the color agent is encapsulated in a sol gel matrix formed from a condensation of an alkoxy silane.

3. The colored flame candle according to claim 1, wherein the alkoxy silane is a methoxy silane.

4. The colored flame candle according to claim 3, wherein the methoxy silane is methyltrimethoxysilane.

5. The colored flame candle according to claim 2, wherein the color agent is a metal salt.

6. The colored flame candle according to claim 5, wherein the metal salt is selected from the group consisting of potassium chloride, copper chloride, lithium chloride, barium chloride, zinc chloride, and combinations thereof.

7. The colored flame candle according to claim 6, wherein the metal salt is lithium chloride.

8. The colored flame candle according to claim 1, wherein the weight ratio of encapsulated color agent to solid combustible material is selected from the group consisting of at least 1:100, at least 1:20, at least 1:10, at least 1:4, and at least 1:2.

9. The colored flame candle according to claim 1, wherein the wick is a single wick disposed in the center of the candle.

10. The colored flame candle according to claim 1, wherein the wick comprises a second encapsulated color agent.

11. The colored flame candle according to claim 1, wherein the body of solid combustible material has an elongated, cylindrical shape.

12. The colored flame candle according to claim 1, wherein the solid combustible material comprises a material selected from the group consisting of animal waxes, plant waxes, mineral waxes, triglycerides, polyamides and combinations thereof.

13. The colored flame candle according to claim 12, wherein the solid combustible material further comprises at least one scent.

14. The colored flame candle according to claim 12, wherein the solid combustible material further comprises at least one dye.

15. The colored flame candle according to claim 12, wherein the solid combustible material further comprises two or more color agents.

16. A colored flame candle comprising: a wick, a body of solid combustible material surrounding the wick except a tip portion of the wick, and a first color agent adapted to color a flame of the candle, which color agent is dispersed within the solid combustible material and/or on the wick, the first color agent being encapsulated in a sol gel matrix formed from a condensation of an alkoxy silane having the formula:

$$R_xSi(OR')_{4-x}$$

wherein

R is independently selected from the group consisting of $C_{1-12}$alkyl, $C_{3-8}$aryl, vinyl, allyl, and hydrogen, wherein each R is independently and optionally substituted with one or more groups selected from the group consisting of fluorine, amino, hydroxy, and combinations thereof;

R' is selected from hydrogen and $C_{1-4}$alkyl; and x is 1-3.

17. The colored flame candle according to claim 16, wherein the alkoxy silane is a methoxy silane.

18. The colored flame candle according to claim 17, wherein the methoxy silane is methyltrimethoxysilane.

19. The colored flame candle according to claim 16, wherein the color agent is a metal salt.

20. The colored flame candle according to claim 19, wherein the metal salt is selected from the group consisting of potassium chloride, copper chloride, lithium chloride, barium chloride, zinc chloride, and combinations thereof.

21. The colored flame candle according to claim 20 wherein the metal salt is lithium chloride.

22. The colored flame candle according to claim 16 wherein the weight ratio of encapsulated color agent to solid combustible material is selected from the group consisting of at least 1:100, at least 1:20, at least 1:10, at least 1:4, and at least 1:2.

* * * * *